US006352257B1

(12) United States Patent
Todaro et al.

(10) Patent No.: US 6,352,257 B1
(45) Date of Patent: Mar. 5, 2002

(54) WEB STABILIZER

(75) Inventors: Frank A. Todaro, Old Saybrook; Daniel J. Williams, Newtown; Brian C. Richardson, Bozrah, all of CT (US)

(73) Assignee: Asterisk, Inc., Old Saybrook, CT (US)

( * ) Notice: Subject to any disclaimer, the term of this patent is extended or adjusted under 35 U.S.C. 154(b) by 0 days.

(21) Appl. No.: 09/437,351

(22) Filed: Nov. 9, 1999

Related U.S. Application Data

(63) Continuation of application No. PCT/US99/19425, filed on Aug. 30, 1999.

(51) Int. Cl.[7] ..... B65H 20/24

(52) U.S. Cl. ..... 271/268; 271/270; 242/417.3; 242/418; 226/118.3; 226/180

(58) Field of Search ..... 271/266, 268, 271/270; 242/417.3, 418; 226/117, 118.3, 180

(56) References Cited

U.S. PATENT DOCUMENTS 3,744,108 A * 7/1973 Greve ..... 28/1
4,011,976 A * 3/1977 Greer ..... 226/8
4,027,828 A * 6/1977 Mathieson ..... 242/56.6
4,129,238 A * 12/1978 Herd ..... 226/29
4,360,137 A * 11/1982 Noe et al. ..... 226/24
5,050,812 A * 9/1991 Mueller ..... 242/58.1
5,419,506 A * 5/1995 Gunday et al. ..... 242/336
5,825,374 A * 10/1998 Albertalli et al. ..... 346/136
6,068,172 A * 5/2000 Huber ..... 226/118.3

OTHER PUBLICATIONS

"ESP–25 Web Synchronization Controller" Catalog Sheet, Energy Saving Products Co. Aug. 31, 1996, 2 pages.

* cited by examiner

*Primary Examiner*—Christopher P. Ellis
*Assistant Examiner*—Mark A. Deuble
(74) *Attorney, Agent, or Firm*—C. G. Nessler

(57) ABSTRACT

Apparatus for reducing peak tensions and tearing in perforated sheet (40) being drawn along a flow path from a stack (S) into a finishing machine (F) is comprised of a drag unit (22), for retarding motion of the sheet; an assist unit (20) for urging the sheet along the flow path; and, a dancer unit (24) for changing the length of the flow path. The assist unit comprises a pair of constant speed rollers (42, 44) supported by mounting blocks (40). The orientation of the assist unit is changed by rotating the mounting blocks. The roller (30) of the dancer unit is spring biased against the sheet.

20 Claims, 5 Drawing Sheets

WEB STABILIZER

This application is a continuation of application PCT/US99/19425 filed Aug. 30, 1999.

TECHNICAL FIELD

The present invention relates to sheet and document handling devices, in particular to devices which assist the movement of sheet, or web, as it is being drawn into a document finishing machine or like device.

BACKGROUND

When sheet, in particular, perforated edge fanfold paper sheet, also referred to herein as web, is drawn from a supply such as a stack into various types of commercial document finishing devices, it is inherent that the motion of the sheet is alternately ceased and then resumed, as the device does certain operations. For instance, if the finishing machine is converting the sheet into pages of forms, and accumulating them, there will be an unsteady rate of sheet movement. It is an observed problem that paper sheet will tend to tear under such situations; obviously, it is due to the tensile strains attending rapid acceleration of sheet.

The tendency for tearing, or even erratic web motion without tearing, limits the rate at which certain finishing machines can process sheet. Tearing can require repeated operator intervention and inferior production. There are numerous installed commercial machines which exhibit such limitations. Thus, there is a need for some kind of device which can be placed upstream of a finishing machine or other processor, to smooth out, or buffer, the sheet motion, and to thereby lessen the tendency of the sheet to tear and to allow higher average sheet speeds and production. Things that have been tried to improve operation. For instance, a dead weight roller or other object has been hung on the sheet to form a loop on the flow path between the supply and the finishing machine. Fan blown air has also been directed at the sheet running along the flow path.

There are prior art devices which are designed to assist the feeding of web. They have been used when the pulling capacity of a constant input speed finishing machine has insufficient power to draw the sheet into the machine. A typical device of such type is comprised of three fixed-position driven rollers. The sheet follows a serpentine path. The speed of the rollers is varied so that the feed rate corresponds with the speed at which the finishing machine demands sheet. Such devices are not known to have been used, nor has the work on the present invention shown them, to be suitable for solving the problem which is described, where the finishing machine demands web at a variable speed and in a cycle which includes stopping, and where the cycle is repeated at high frequency.

DISCLOSURE OF INVENTION

An object of the invention is to lessen the forces on a sheet or web which is subjected to high acceleration and deceleration, to decrease any tendency for the sheet to tear when the sheet is being drawn into a finishing machine or other processor. A further object of the invention is to provide an improved means for assisting the movement of sheet along a path, where the amount of force imparted to the sheet is readily adjustable.

In accordance with the invention, apparatus for controlling the movement of sheet downstream along a flow path, toward a finishing machine device which pulls the sheet downstream from a source or supply with frequent change in velocity, comprises an assist unit, for urging the sheet downstream; and a dancer unit, preferably a resiliently biased dancer unit, positioned downstream of the assist unit, for dynamically changing the length of the flow path between the sheet source and the device. The combination of assist unit and dancer unit change the velocity vs. time cycle to which sheet is subjected at points upstream of the finishing machine entrance, compared to the cycle at the finishing machine, to lower the acceleration of the sheet and the tension in the sheet.

In one aspect of the invention, the tension ratio of the assist unit is less than 6 to 1, preferably less than 3 to 1, where tension ratio is the ratio of the tension in sheet at the input side of the assist unit divided by tension in sheet at the output side of the assist unit, measured when the assist unit is acting on a piece of sheet being restrained in place. In another aspect of the invention, the assist unit has at least two drive rollers and the total angle of wrap of sheet about all the drive rollers is no more than 2 $\pi$ radians, preferably 3 $\pi/2$. In another aspect of the invention, the velocity of sheet through the assist unit is less than the rotational surface speed of the at least one drive roller. The invention may include a drag unit located upstream of the assist unit. However, in some systems the inherent drag on the sheet may not demand a separate drag unit.

In a preferred embodiment, the assist unit is comprised of only two drive rollers. The sheet flow path through the assist unit has an S-shape, as the sheet wraps around a portion of the exterior of each roller. The orientation of the drive roller pair is changeable, to a desired fixed position, to effect a change in shape of the S path through the assist unit. Thus, the angle of wrap of sheet within the assist unit and the tension ratio of the assist unit can be changed to a desired predetermined level. Preferably, one roller axis stays at a fixed position and the second roller is journaled in a pivotable mounting block, so the second roller moves with planetary motion about the first. Preferably, the assist unit runs at constant speed.

In a preferred embodiment, the dancer unit is comprised of a dancer roller assembly which translates vertically in space. The roller assembly has quite a low mass and is spring biased in a direction which increases the flow path length. An exemplary low mass dancer roller is constructed of thin wall plastic tubing. The weight of the roller assembly ought to be much less than 4 $gF/a_{web}$, where F is the maximum tension the sheet can sustain and $a_{web}$ is the maximum acceleration of the sheet at the inlet of the finishing machine and g is the acceleration of gravity. In proper use, the combination of low mass roller and spring bias keeps the roller in close proximity to the sheet as the flow path dynamically changes, thus avoiding roller impulse forces on the sheet which might tear the sheet when the roller substantially separates from contact with the sheet. Preferably, the dancer roller assembly translates along a path defined by vertical rails and the sheet follows a narrow V-shape flow path around the dancer roller.

In the method of the invention the motion of sheet is affected at sequential points along the flow path between a supply of sheet and the finishing machine which pulls the sheet with frequent change in velocity, including periodic stopping of the sheet, thereby creating a certain acceleration and tension in the sheet at the entrance to the finishing machine. A drag force is applied at a first point, a force which urges the sheet downstream is applied at a second downstream point, and a resilient force is applied to the sheet at a third further downstream point. The flow path is changed in length inversely with change in velocity of the sheet at the finishing machine. The tension in the sheet as it enters the finishing machine is reduced.

In operation, the invention reduces the stress which is generated in the sheet as a result of the action of the finishing machine. It thus reduces any tendency for tearing, and it improves the operation of most finishing machines, making them capable of high speed operation.

The foregoing and other objects, features and advantages of the present invention will become more apparent from the following description of preferred embodiments and accompanying drawings.

BEST MODE FOR CARRYING OUT THE INVENTION

The invention is described in terms of its use with fanfold sheet made of paper drawn from a source or supply which may be a stack of zig-zag folded paper, paper issuing from a roll, or paper presented in some other manner. Fanfold sheet has transverse perforations so the sheet may be readily stacked. It will be appreciated that the invention will be useful with other forms of sheet and other sheet materials. The invention is referred to as a "web stabilizer". This reflects the concept that the normal stop-and-go of a finishing machine causes the sheet being drawn into it to move erratically. The invention changes the motion of the sheet along the flow path running between the source and finishing machine, making it less erratic, and thus more stable. "Web" is a reference to sheet, whether drawn from a roll (as the term is traditionally used) or from a stack; it is used in this description interchangeably with the word sheet. The term roller refers to a cylinder which is adapted to rotate about a lengthwise axis.

Figure 11:
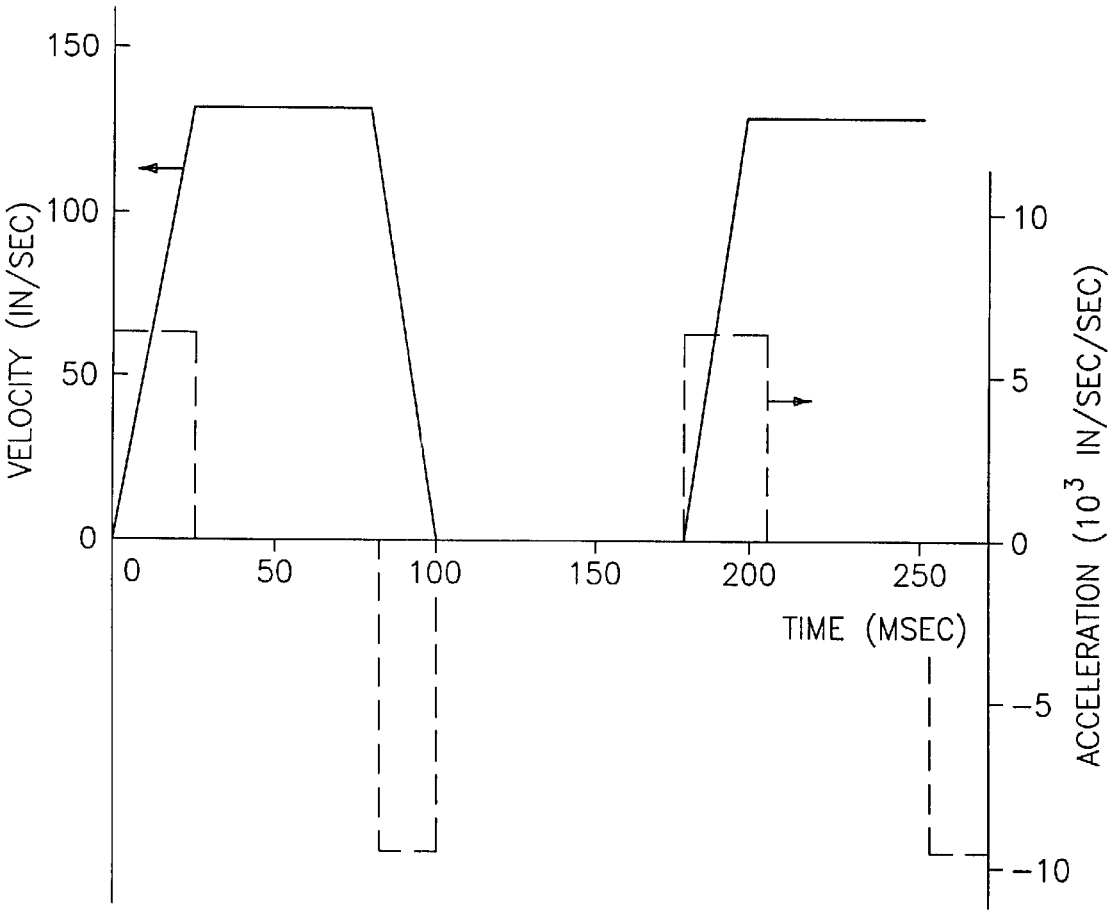
FIG. 11 is a plot showing the velocity and acceleration which sheet is subjected to at the input of one particular finishing machine, as a function of time.

The invention may be used with various devices which process sheet, and for the claimed invention, the term finishing machine is not intended to be limiting. For purposes of this best mode description the invention is assumed it is used in connection with a commercial finishing machine which is processing sheet such as 8.5–17 inch wide 20 pound weight common fanfold office paper, having perforations with about 0.31 pound/inch tensile or pull-apart strength, or about 5 pound total. The finishing machine receives fanfold sheet to process it. Typically, a finishing machine may function to separate the sheet into the individual pages or forms as they are defined by the perforations, and to accumulate related pages as sets—such as the pages of a bank statement being sent to a consumer. Finishers may run at high speeds and subject the sheet to a rapid acceleration and deceleration. For instance, a typical sheet velocity profile or cycle measured at the input of a finishing machine might comprise an acceleration phase, wherein velocity increases from 0 to about 135 inch per second (ips) in about 25 milliseconds (ms); followed by constant velocity of about 135 ips for about 64 ms; followed by deceleration to 0 ips in about 15 ms; followed by no motion for about 87 ms; whereupon the cycle repeats. The velocity vs. time cycle is shown in FIG. 11. The cycles are repeated a high rates and there may be variations in the length of the rest time within some cycles.

Figure 1:
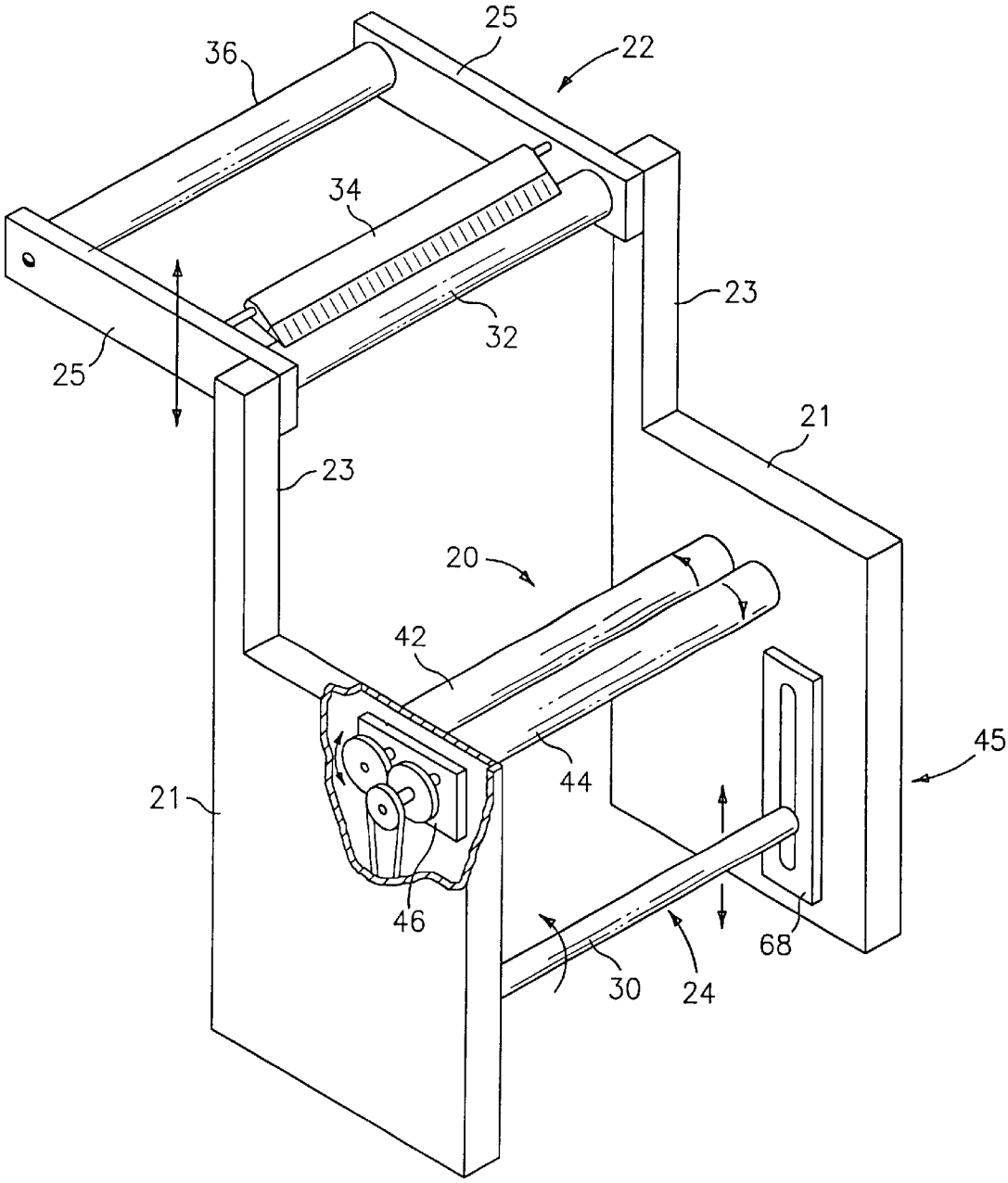
FIG. 1 is a perspective view of a web stabilizer machine.

FIG. 1 shows the machinery of a web stabilizer system in perspective. It should be considered by also making reference to FIG. 2, which is a largely schematic drawing showing the several components of the system and how a sheet moves through the system.

Referring to FIG. 1 the stabilizer is comprised of three components: A drag unit 22, an assist unit 20, and a dancer unit 24. The drag unit is an assembly which inhibits or retards downstream motion of a sheet. The assist unit is an assembly which enhances or increases downstream motion of a sheet. The dancer unit is an assembly which dynamically varies the length of the sheet which runs from the source and the finishing machine being served.

Figure 2:
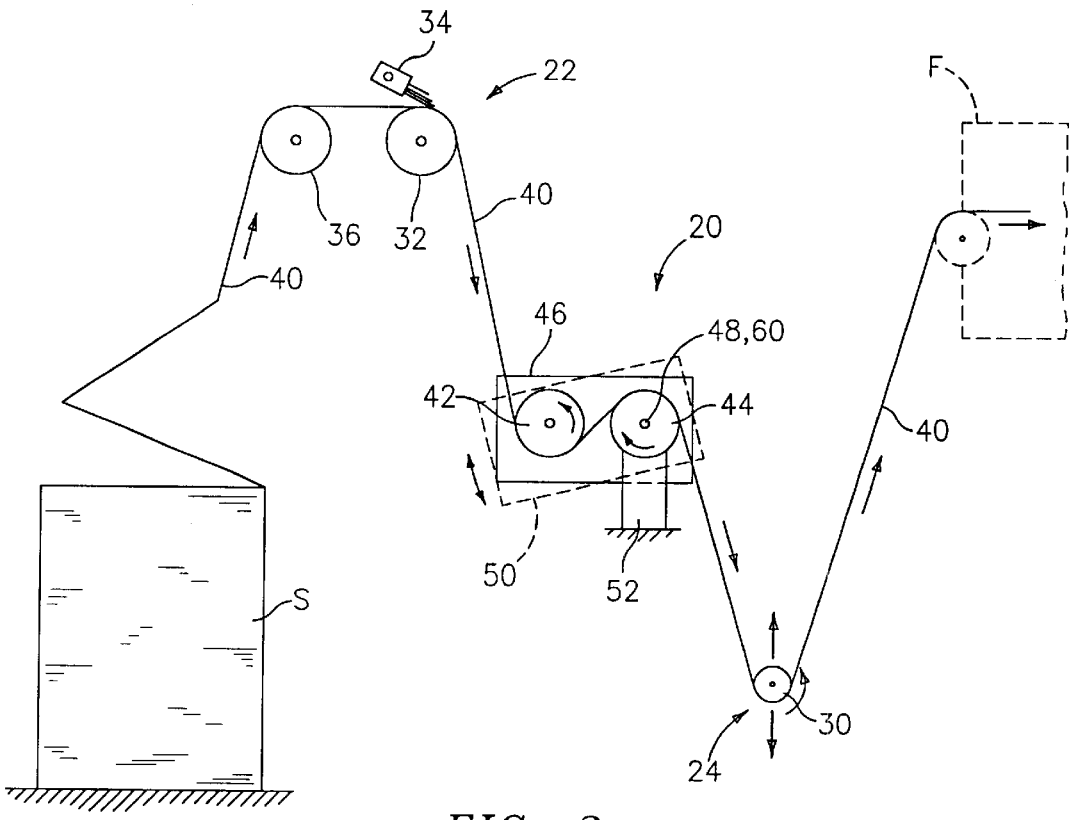
FIG. 2 is a largely schematic illustration of the mechanisms of the FIG. 1 web stabilizer, showing sheet motion from a stack to a finisher, and the motions of the various components.

The side elevation schematic of FIG. 2 shows how the system functions, as fanfold sheet 40 is drawn from a stack S and fed into a finishing machine F, shown in phantom. The motions of various components are indicated by small arrows. The sheet 40 passes serially through drag unit 22, then through assist unit 20, then around roller 30 of dancer unit 24, and then to the input structure of the finishing machine F, shown in phantom.

The drag unit retards the downstream motion of a sheet by means of frictional force generated by a fiber brush 34 and static drag cylinder 32. Static infeed cylinder 36 guides the paper toward the drag roller. The cylinders are fixedly mounted between support frames 25. The support frames mount off vertical columns 23 of the base 45. The support frames are fastened to the columns 23 by unshown sliding clamp mechanisms, or the like, so the drag unit may be adjustably positioned at any desired vertical elevation relative to the assist unit. Tie bars and other structure which connects the opposing structural sheet metal sides of the base 45 are omitted from the Figure for clarity.

The preferred drag unit 22 is comprised of a static cylinder 32, for instance a tube, upon which bears a stiff brush 34 comprised of mixed metal and organic fibers. The brush is pivotably mounted between the frames 25 which support it and the cylinders. The friction of the brush with the sheet 40 can be adjusted by changing a spring force on the brush holder, or by other biasing means which cause the fibers of the brush to bear harder or lighter on the cylinder. The friction from the brush and cylinder provides resistance to downstream movement of the sheet. The upstream cylinder 36 is optional. It guides the sheet from the stack toward the roller 32. Not shown are adjustable guides running lengthwise between the cylinders, to center or otherwise position the sheet relative to the width of the cylinders. Also, rails or other structure will be desirably positioned to run lengthwise within the space between the two cylinders, to minimize any sagging of the sheet between the cylinders.

The need for the drag unit is a function of the dynamics of the system and sheet. Thus, the drag unit need not be used if there are other sources of drag force in the system, upstream of the assist unit, which are sufficient to retard downstream motion of sheet, to a degree sufficient to cause the desired assist unit action, and to prevent unwanted inertial motion of the sheet from the supply. A typical drag force is a small fraction of the tensile strength of the sheet. For instance, in the preferred embodiment, the drag force is around 0.3 pounds, compared to sheet strength of 5 pounds.

From the rest of the description, it will be appreciated that other types of drag units or sheet retarders known in the prior art may be substituted for the preferred drag unit 22. For instance, the sheet may pass through the nip of two free wheeling rubber rollers where one has an adjustable friction brake. The amount of drag applied by the drag unit will be adjusted according to whatever other drag the sheet running between the source and the assist unit is subjected to.

The assist unit 20 is comprised of two driven rollers 42, 44. The rollers are positioned to cause the sheet to follow an S-shape path. The assist unit frictionally urges the sheet in the downstream direction—that is, it assists, or increases, the sheet downstream motion. The amount of urging is controllable by changing the orientation of the roller pair in the vertical plane, and relative to the path which sheet would follow if the assist unit was not present, as described further below.

The assist unit 20 acts in coordination with the action of the dancer unit 24. As will be appreciated from further description, another way of looking at the assist unit function is that it decreases the tension in the sheet downstream of the assist unit, in particular in the sheet which is entering the input end the machine F, from what it would otherwise be if the assist unit were not present. On the other hand, it does not reduce the downstream tension to the point where the tension at the dancer roller is insufficient to cause the dancer roller to move upwardly against the dancer unit springs.

Figure 3:
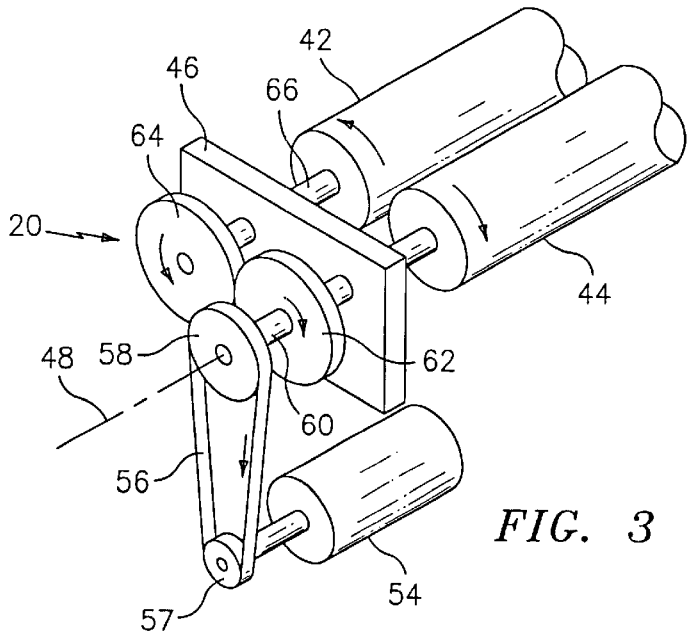
FIG. 3 is a partial perspective view of the drive end of the assist unit.

The drive end of the assist unit is shown in FIG. 3. Referring to FIGS. 1–3, sheet 40 runs along an S shape path through the spaced apart assist unit rollers, running around a first roller 42 and a second roller 44, both of which are driven. The rollers are made of AISI 304 stainless steel and have an arithmetic average surface finish of about 8 microinch, produced by turning and polishing. The longitudinal axes of the rollers are parallel. The rollers each have small axles extending from each end, and the axles are journaled in pivotable mounting blocks 46. The mounting blocks pivot in space with respect to the machine frame 45, about the axis 48 of rotation of shaft 60 and roller 44. The roller 42 thus is moved in planetary fashion about roller 44; and, the orientation of the roller pair relative to the rest of the system is changed. Rotation of a block set to a desired rotational position can be accomplished in various common ways. The blocks may be moved manually and then locked in position by a clamp; or a screw may be positioned to bear on a block when it is turned, to move the block. Of course, both blocks move together.

As an example of the effect of rotating the blocks, the mounting block 46 can move counterclockwise to the position shown by phantom block 50 in FIG. 2. With counterclockwise block rotation, roller 42 moves counterclockwise about roller 44. For the configuration shown, it moves downwardly. Thus, the length of circumferential frictional engagement of the sheet with both rollers is thereby increased. Conversely, clockwise motion reduces engagement, to the point that, with sufficient block rotation, there will be minimal engagement.

When the orientation of the two drive rollers is adjustable as described, a simplification in assist unit design is possible. The rotational speed, and thus the surface speed, of the rollers is able to be made constant, preferably at about 135 surface inches per second for the exemplary finishing machine. In operation of the assist unit with a finishing machine, there is continuous slip of varying amount between the sheet and rollers. In operation, the downstream urging force on the sheet, for any given instantaneous tension on the sheet, can be set by selecting a desired degree of rotation of the mounting blocks, since changing the orientation of the rollers by rotation of the mounting blocks changes the shape of the S-shape curve which the sheet is made to follow around the roller pair. The change in S-shape curve corresponds with a change in the amount of the circumference of each driven roller which is in contact with the sheet and thus the force applied to the sheet. The total of the angles of contact which the sheet has with the rollers is referred to here in terms of the "angle of wrap" or "wrap angle", and is measured in radians.

In typical operation, for sheet moving into a finishing machine with nominal velocity parametrics indicated above, the block of the assist unit will be set so the sheet wraps around the circumferences of each roller 42 and roller 44 in a manner such that it contacts the surface of each along an arc, having an angle of about 3 $\pi/4$ radian. The total angle of wrap for the assist unit is thus about 37 $\pi/2$ radian. The mounting block rotation and resultant shape of the S-curve will be varied according to the particular sheet and finishing machine parameters and experience. In a system using the preferred two-drive roller assist unit, the angle of wrap will range between $\pi$ and 2 $\pi$ radian, and preferably it will be about 3 $\pi/2$ radian.

FIG. 3 shows the roller drive system. A constant speed motor 54 rotates drive pulley 57 and the round belt 56 mounted thereon, thereby driving driven pulley 58. The pulley 58 rotates shaft 60 to which it is fastened, along with the polyurethane disk 62 and feed roller 44 which are also fixed to the shaft. Disk 62 is frictionally engaged with like disk 64. Disk 64 is mounted on shaft 66 and thus roller 42 is thereby rotated by the interaction of disks 62, 64. The use of smooth (i.e., non-serrated) pulleys and the light degree of engagement between the disks 62, 64 will tend to allow rollers 42, 44 to slip, should some object other than sheet be drawn into the rollers.

Figure 6:
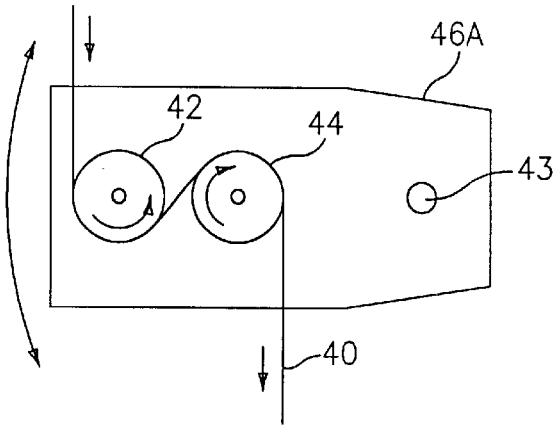
FIG. 6 shows a two-roller assist unit having a pivotable mounting block, for varying the wrap of the sheet around the rollers.
Figure 7:
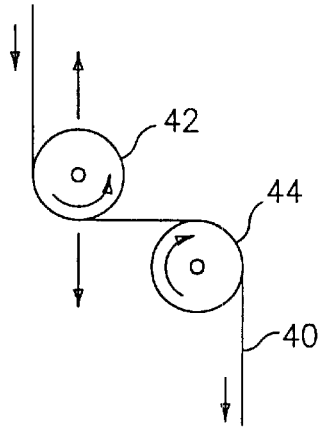
FIG. 7 shows a two-roller assist unit wherein one roller moves vertically, to vary the wrap of the sheet around the rollers.

Changing the shape of the S-shape flow path in a two-roller assist unit may be accomplished in other ways. For example, both rollers 42, 44 may be rotated about some other point of rotation than the longitudinal axis of roller 44. The point of rotation may be located between the rollers, or it may be spaced away from the rollers, as is point 43 of block 46A shown in FIG. 6. Also the same functional result may be achieved by having one of the two drive rollers move vertically relative to the other. See FIG. 7.

The dancer unit 24 is comprised of a horizontal dancer roller 30 which is adapted to move vertically. The dancer roller 30 has stub axles which are journaled in plastic blocks which run vertically along opposing side rails 68 which are attached to the base. The dancer unit moves dynamically during operation of the invention, to shorten and increase the length of the sheet path at a high speed, inversely to the sense of sheet velocity change at the entrance of machine F, in a complex way, as described below.

Figure 4:
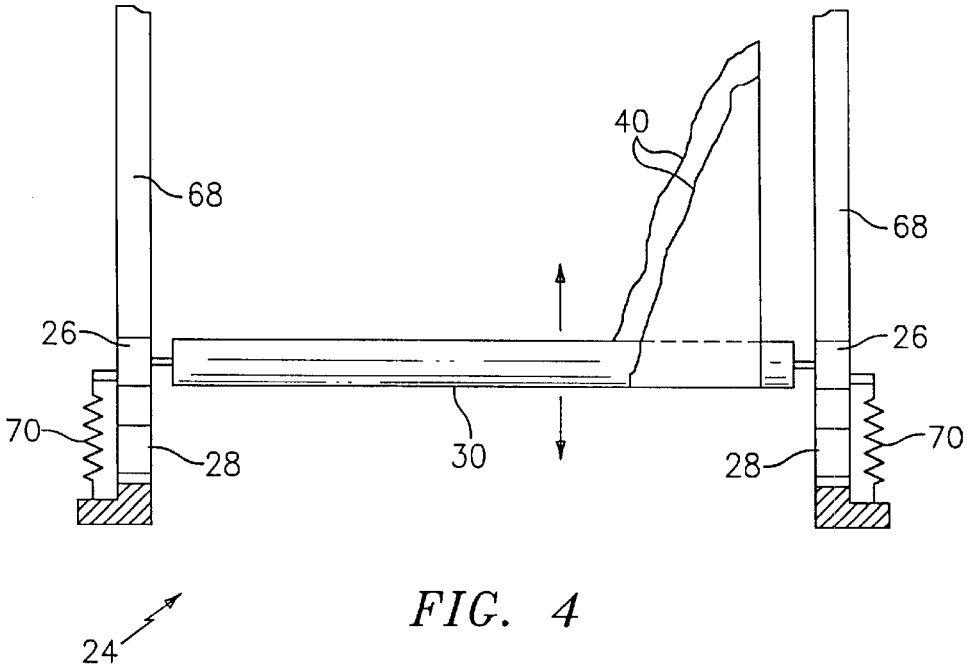
FIG. 4 is a view from the output end of the stabilizer, showing the dancer unit.
Figure 5:
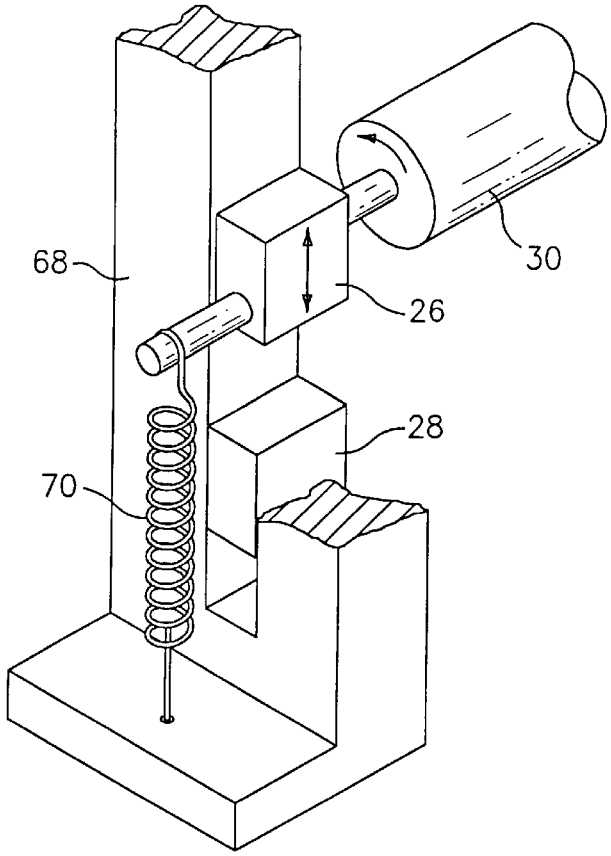
FIG. 5 is a partial perspective view of one end of the dancer unit shown in FIG. 3.

FIG. 4 is an elevation view of the dancer unit, looking from the output end of the stabilizer, i.e., from the right of the machine of FIG. 1. It shows how the dancer is comprised of a dynamic roller 30 which is pivotably mounted in journal blocks 26. The blocks 26, which are preferably polyurethane plastic, are vertically slidable in the channels of vertical rails 68. (Not shown for simplicity, are retainers which keep the blocks and roller from moving lengthwise.) Thus, the roller translates upwardly when there is sufficient force imposed by the sheet 40. It moves downwardly when the sheet tension is relaxed, due to action of springs 70 and the weight of the roller assembly, until the journal blocks hit stops 28.

It will be appreciated that other means for guiding the dancer roller along its translating path may be employed in substitution of the rails. For instance, pantograph type supports may be used at opposing ends of the roller. Furthermore, the dancer roller may be mounted on a frame which enables the roller to move in a large arc, to approximate the linear vertical path. The roller may move in a direction other than vertically upward, so long as the dynamics of the preferred mode described herein are approximated. While steel coil springs are preferred, other means for resiliently or elastically biasing the roller may be employed. For example, air springs or elastomer bands may be used; or, a complex electromechanical system might be employed.

The following describes phenomenologically how the system operates when connected to a finishing machine moving the sheet according to the nominal velocity vs. time cycle shown in FIG. 11. Consider first that the sheet is initially stationary, and suddenly finisher F starts accelerating the sheet. In the first moment that the machine F pulls, both the inertia of the sheet and the resistive force applied by the drag unit inhibit sheet motion. The tension in the sheet rises sufficiently to cause the dancer roller 30 to be pulled upwardly. This causes the sheet path to temporarily shorten. The roller 30 moves upwardly but against increasing resistance due to action of springs 70.

The resultant tension in the sheet has an effect at the assist unit. It creates a normal force between the sheet surface and the surfaces of the assist unit. This causes the sheet to be frictionally engaged with the rotating rollers 42, 44 of the assist unit, and to thus be driven along the flow path toward the dancer unit. It will be understood that the assist unit, like a nautical capstan, provides a force on the upstream portion of the sheet which is an amplification of the tensile force applied to the downstream portion of the sheet. The net action of the assist unit—in combination with the dancer unit and the machine F—is complex, analogous to a dynamic feedback loop control system. There are many subtleties and interdependencies in the full system of the invention, and the resultant simplifications and limitations attending the analyses hereafter should be appreciated.

Assume for a moment that acceleration of sheet at machine F suddenly turns negative. This occurs when machine F slows down, to the point where it momentarily stops the sheet from moving at the entrance of machine F. Just prior to the decrease in acceleration, the assist unit has been urging the sheet toward die roller 30 of dancer unit at a certain rate. When the deceleration of sheet takes place at machine F, there remains a tension in the sheet at the assist unit and at the dancer unit, due to the action of the springs of the dancer unit. Furthermore, momentum of the sheet tends to keep the sheet moving toward the machine F notwithstanding the effect of the drag unit. The dancer roller 30 moves downwardly as the tension in the sheet falls, and the sheet flow path increases in length. Finally, if roller reaches its bottommost stop position, the tension on the sheet at the output side of the assist unit is reduced to near zero, and the assist unit stops moving the sheet. In practice, the roller does not move down to the stops, but oscillates about a point along the rails which is well above the stops.

A typical drag unit is effective in minimizing continued motion of the sheet due to momentum of the sheet. In the absence of the drag unit, excess sheet could otherwise accumulate in the path between the drag unit and the finisher, when the sheet velocity at machine F drops to zero. Upon resumed downstream motion, the taking up of this slack would apply shock forces to the sheet which ought be avoided.

The dancer roller 30 must have a certain initial or setup position for proper functioning. This is illustrated by example from the preferred embodiment, where the roller has an 8 inch travel path and will be found to oscillate within a 2 inch portion of the travel path. A typical initial setup position is about 2 inch above the lower stops 28, or about 25% along the travel path. The setup is carried out with the assist unit running, and with slack removed from the sheet running from the drag unit to the machine F. The setup position will be that at which the downward force induced by springs 70 on the sheet, which is running in a narrow V around the roller, is at the threshold of overcoming the resistance force of the drag unit and what ever other drag is present in the system. At the setup point, any significant incremental roller force causes sheet to be pulled through the drag unit. If the vertical spring force on roller 30 at its setup position is less than just specified, it is found that, with continual stopping and starting of the sheet, the lowermost position of the roller 30 will progress upward with each cycle. That adversely affects the available length of travel, and thus the take up capacity of the dancer unit. Ultimately, the roller reaches the end of the rail path and acts as a fixed position roller, causing the sheet to tear. In practice, there is a spring force on the dancer roller assembly even when sheet is not present or is allowed to go slack, so that the force holds the roller assembly against the lower stops. It will appreciated that the precise adjustment of the roller assembly, the choice of force and spring rate provided by the springs, the wrap angle of the assist unit, and so forth, usually require some trial and error and fine tuning, for any particular finishing machine and sheet stock.

The useful travel length of the roller 30 along rails 68 is related to the length of the form or page defined by transverse perforations in the sheet, for systems where there is stop and go motion for each form. The travel length ought to be at least one-half of the length of a form. In the preferred embodiment, the dancer roller is adapted to move along a travel path of up to about 8 inch, about half of the length of a 14 inch form. Each coil spring is about 2 inch long and has a spring rate of about 1 pound/inch.

Figure 10:
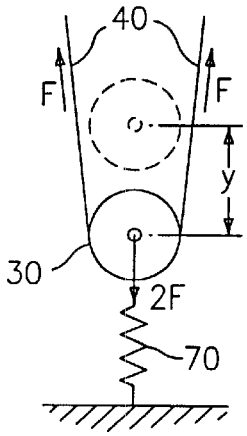
FIG. 10 is a simplified diagram showing the balance of forces on the dancer roller.

Reference should be made to FIG. 10 which is discussed further below. The forces applied by the two springs are balanced by the tensions in the sheet which runs in a narrow V path. For simplicity it is assumed that the legs of the V are parallel. Thus, at the 8 inch maximum spring extension, the maximum spring force which a 5 pound tensile strength sheet can sustain can be determined. The maximum spring rate parameter may be calculated. Solving the simple equations indicates that the maximum spring rate ought to be 0.6. In practice, with paper sheet, springs with a spring rate of 0.1 are used. At the full 8 inch extension of the roller springs, the preferred embodiment dancer unit applies a spring force of 0.8 pounds to the dancer roller, or a tension of 0.4 pounds to the sheet. This is about 10 percent of the ultimate tensile strength, or tear point, of the perforated sheet. Thus, the maximum force applied by the springs should be substantially less than the maximum tension which the sheet can sustain without tearing. The tension in the sheet which the dancer unit can induce acting by itself on a static sheet is substantially less than the tensile strength of the sheet. See below.

It is particularly important to the good functioning of the invention that the mass (weight) of the dancer roller assembly be low. The roller assembly in this context constitutes the dynamically moving portions of the dancer unit, namely roller 30 and the two journal blocks. Portions of the springs move dynamically also, but they are quite light and thus are ignored in this discussion. In a preferred embodiment, the total weight of the roller assembly which comprises a 20 inch long by one inch outside diameter roller is about 0.18 pound. The preferred roller is a hollow phenolic resin tube.

Experiments have shown the advantage, and even the necessity, of having low mass. In the first instance, low mass refers to a roller assembly comprising a roller which is significantly lower in mass than the common thin wall aluminum or stainless steel rollers that are familiar for most purposes to those skilled in the art. A thin wall phenolic tube is an example of a comparatively low mass roller.

One analysis of how the system works, and why low mass is important, is as follows: When, due to demand by the machine F, the velocity of the sheet at machine F input is increased, the invention causes the velocity upstream of the machine to change less rapidly than otherwise. That is, the invention dampens the sheet acceleration. In the absence of an assist unit, when the acceleration is thus decreased, the tension in the sheet is decreased in direct proportion; however, machine F must do all the work in pulling the sheet. The highest tension will be at the machine F. When the kind of assist unit described herein is used, it provides a boost to the sheet in cooperation with machine F, and reduces the tension which the machine F must create to impart to the sheet any given acceleration at any given point along the flow path.

A reduction is sheet tension which machine F must exert on sheet results in improved performance. There is a reduction in propensity for tearing, both at sheet perforations and at the sprocket holes (by action of the tractor of machine F). This is accomplished in part by shortening of the paper path at the dancer unit. Thus, it will be understood that if the roller is too heavy, then in the sheet acceleration phase, there could be too little "give" provided by the dancer unit, because there is too much inertia. That is, a more substantial force would have to be applied to the roller to move it upwardly—which necessitates undue tension in the sheet. In the limiting case, the roller is so heavy that it acts like a fixed roller, in which case there would be no lessening of sheet tension. So, this is the first reason for low mass.

The second reason is as follows. When sheet speed is increasing, the roller 30 is moved upwardly by the resultant increasing sheet tension. When the machine F suddenly slows the sheet, and the tension decreases, the length of the sheet running along the sheet path will not only stop tending to shorten, but it will actually tend to lengthen, because the feed unit has imparted momentum to the sheet which is approaching the dancer unit. At the same time, the roller has upward momentum and wants to continue on its upward path. It may lift off the sheet, or it may stay in contact with diminished force. Only when the combined pull of gravity and spring force on the roller overcomes its momentum will the roller accelerate downwardly sufficiently, to fall back into full contact with the sheet. So the sheet may thus be subjected to an impulse load which will sharply increase tension in the sheet, even to the point of tearing it. Thus, when the mass of the roller is low, there is less momentum and less potential impulse load. Any given combination of gravity and spring force will dominate the motion of the roller, compared to momentum. It is possible to increase the spring force to compensate for high mass, but doing that is inimical to the first reason, namely, the aim of enabling the sheet path to be shortened when there is acceleration of the sheet downstream. In the invention, the combination of springs and low mass roller keep the roller in close proximity, particularly during the part of the action where the roller decelerating, that is where it is reaching its uppermost limit and reversing direction. Most times the roller will stay in contact with the sheet; but at times it may separate slight. However any separation will be insubstantial insofar as any adverse effect on the sheet.

Of course, what the weight is for an acceptable upper-limit roller mass will depend on the sheet properties, the acceleration imparted by the finisher and other parameters. In the developmental systems, we have calculated that when a finisher imparts an input acceleration of 15 g to a paper sheet, where g is the acceleration of gravity. We have calculated that in our system in one typical instance, the acceleration of sheet at a flow path point upstream of the dancer unit is lowered to about 8 g. A flow path point upstream of the dancer unit is defined as being one which is upstream of the point where sheet contacts the upstream side of the dancer roller.

The weight of a low mass roller can be calculated in terms of parameters of the system. Considering the simplified situation shown in the schematic of FIG. 10, when the machine F first instantaneously pulls on the sheet 40. As a simplification, it is assumed the acceleration of the sheet upstream of the dancer is zero, the downward force of the two springs 70 (one shown) is nominally equal to the summation of tension in the web, or 2 F. Simple mechanics dictates that the acceleration of the sheet provided by the finishing machine is two times the acceleration of the dancer roller. Thus $$2F = ma_{dancer} \tag{1}$$

$$2F = \frac{m \times a_{web}}{2} \tag{2}$$

$$m = 4F / a_{web} \tag{3}$$

$$weight = mg = 4Fg / a_{web} \tag{4}$$

where m is mass of the dancer roller assembly, F is sheet tension, and $a_{web}$ is acceleration, and g is acceleration due to gravity. A finishing machine of the type described ordinarily would provide about 15 g of maximum acceleration. Suppose the sheet strength, or maximum sustainable tension, is 5 pounds. Putting these values in the equation indicates a maximum roller assembly weight of about 1.3 pounds would cause breakage of the sheet when the finishing machine started up. So, it is evident the roller assembly should be substantially less in mass/weight than the values dictated by equations (3)/(4), to provide margin of safety and to account for the simplifications of the analysis. As mentioned, a preferred roller assembly weighs about 0.18 pounds or about 14% of the calculated maximum weight.

Thus, it will be understood that the system described is effective in reducing the tension in the sheet which is drawn from a stack. It addition to reducing the stress in the sheet along the sheet path, due to stop and start motion, the invention causes sheet to be drawn more smoothly from the top of the zig-zag stack. Both effects reduce the propensity for tearing. Furthermore, it is found that the motion of the sheet at the entry to the finishing machine is made more smooth or even. As a result there is less fluttering and errant motion of the sheet with respect to the finishing machine per se, and its performance is improved.

Referring again to the preferred roller type assist unit 20, the principles of operation are similar to those which attend flat belt drives in general, and thus an analysis of assist unit operation is as follows. The amount of urging of the sheet which the assist unit provides to sheet is determinable in terms of the difference between the sheet tension F1 measured at the input or upstream side of the unit and sheet tension F2 measured at the output or downstream side of the unit. The tension ratio $$F1/F2=e^{f\theta} \quad (5)$$

where f is the coefficient of friction and θ is the angle of wrap in radians. The coefficient of friction between the stainless steel rollers and common paper sheet is typically about 0.15. Calculations and experiment show what is special about the preferred assist unit of the invention.

To calculate tension ratio, the obvious insertions in the formula are made. To measure tension ratio of an assist unit, a piece of sheet is inserted normally in the unit. The input side end and output side end of the piece sheet are connected to force measuring devices, such a spring scales or load cells. The unit is operated and the forces (tensions) are thus measured. This gives a reasonable approximation of the functioning and tension ratio of which the assist unit provides to sheet when it is continuously moving through the unit, as in normal operation. It is how tension ratio is measured within the meaning of the claims. There is reasonable correlation between the experimentally measured and calculated tension ratios. The tensions and tension ratios in sheet which is actually being fed along the flow path have not been measured because of the difficulty of doing so. When sheet is being fed, there can be factors which could alter the tensions and tension ratio of an assist unit. But, they are not considered of such consequence as to produce a substantially different result, particularly when different types of assist units are being compared. Such factors can include the amount of slippage, centrifugal effects on the sheet, and so forth.

For the preferred embodiment two roller assist unit, with a wrap angle of around 3 π/2 radian, the tension ratio will be in the range of 2–3 to 1. As an example, for the preferred two-roller assist unit and 17 inch wide sheet, operation of the assist unit with the drag unit set for about 0.31 pound of resistive sheet tension, shows the upstream side sheet tension is about 0.31 pound and the downstream side sheet tension is about 0.16 pound.

Figure 9:
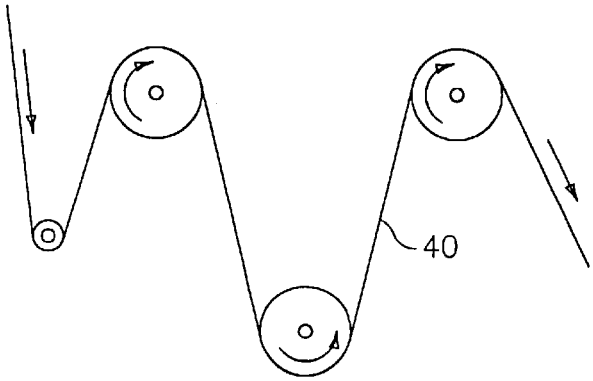
FIG. 9 (PRIOR ART)
FIG. 9 shows a prior art three-roller assist unit wherein all rollers are fixed.

The invention assist unit can be compared to a typical prior art three-roller assist unit, such as a commercial unit available from Moore Business Equipment Co., Dover, N.H., USA. Such unit has a drive roller arrangement like that schematically shown in FIG. 9. The wrap angle is a bit less than 3 π radian, and the unit provides a tension ratio of from 6 to 1 to 9 to 1. The upstream side tension is about 0.31 pound and the downstream side tension is less than about 0.15 pound. A corollary of such results is that for a given generation of downstream sheet tension as a result of finishing machine action, the prior art assist unit would over-feed, whereas the invention assist unit will not. Using the prior art Moore assist unit with the dancer is not effective. As soon as a slight pull or tension from the finishing machine is transmitted through the sheet running around the dancer roller, the prior art assist unit feeds the sheet greatly. Thus, the tension in the sheet does not rise sufficiently to cause the dancer roller to rise. Too much sheet is fed and slack accumulates in vicinity of the dancer when the pull lessens or ceases. Then, when the pull resumes, the resultant whipping causes the sheet to tear, unless the speed of the machine is slowed to undesirably low rates. Slowing the speed of the prior art assist unit drive rollers is not effective in overcoming the problem. Only the lower tension ratio enables the desired purpose of web stabilization to be achieved in the practice of the invention. Thus, the tension ratio of the assist unit in the invention ought be less than 6 to 1, and preferably 2–3 to 1 or less when processing common paper sheet of the type which has been described.

Figure 8:
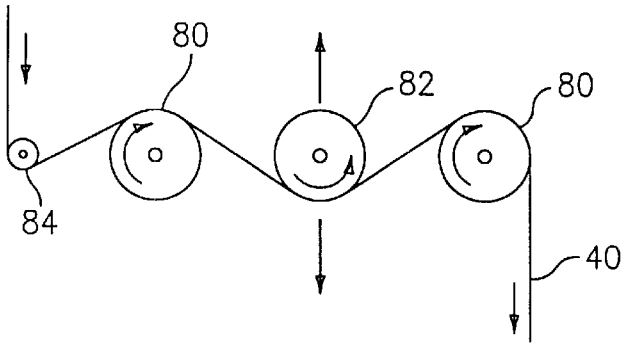
FIG. 8 shows a three-roller assist unit wherein the middle roller moves vertically to vary the wrap of the sheet around the rollers.

The preferred two-roller assist unit best provides the desired tension ratio. Nonetheless, other configurations of assist units may be employed which provide the tension ratio which is necessary. For example, a three roller assist unit is shown in FIG. 8. The constant speed rollers 80, 82 all act to drive the sheet 40 when there is sufficient initial tension applied at the output side to cause the sheet to frictionally engage the rollers. The roller 84 is an idler. Roller 82 can be positioned to a fixed predetermined vertical position to vary the angle of wrap which sheet has in the unit, and to thus provide the desired tension ratio. Other configurations of assist unit may be employed.

As described above, the sheet velocity and acceleration, as a function of time, is altered by the invention, compared to that which is dictated at the input of the finishing machine F by the machine. When in practice of the prior art, sheet is drawn directly from a source, for instance, simply around some turn bars, typically with a drag unit, the velocity of the sheet upstream of machine F closely approximates the velocity of the sheet at the machine input. Often, with high speed finishing machines, decelerations can approximate 20 g; and, a very strong drag has to be applied to the sheet near the source to prevent sheet overshoot or "waterfalling". The high drag results in a necessarily high sheet tension, as the machine must pull hard enough on acceleration to overcome the drag force. A propensity for tearing is thus introduced.

Figure 12:
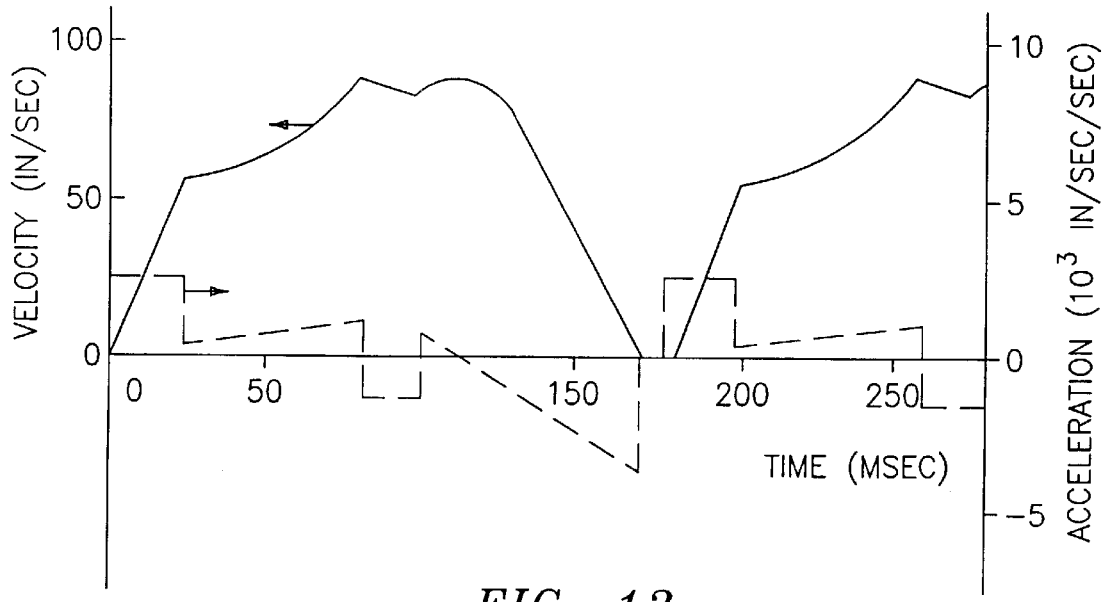
FIG. 12 is a plot corresponding with FIG. 11, illustrating the modified motion of sheet, at a point just upstream of the dancer unit, as a result of using the invention.

FIG. 11 is a plot showing the velocity and acceleration which sheet is subjected to at the input of one particular finishing machine, as a function of time. It shows the pull cycle which is mentioned at the beginning of this description. The cycle is repeated at high frequencies. For instance, a typical commercial finishing machine, Model 6000 Mail Processing System (Bell & Howell, Inc., Durham, N.C., USA) repeats the cycle at a rate of about 5 or 6 cycles per second, processing sheet with perforations 8.5 inch apart. FIG. 12 is a plot corresponding with FIG. 11, illustrating thy modified motion of sheet, at a point just upstream of the dancer unit, as a result of using the invention. Both plots are approximations and simplifications of the real cycles, but the qualitative differences are real.

It is observed that the effect of the invention is to substantially alter the shape of the velocity vs. time cycle.

The time of movement during the cycle is significantly increased and the magnitudes of acceleration and deceleration are reduced. These effects reduce the stress in the sheet and the tendency for tearing.

It will be appreciated that the assist unit and the dancer unit may each be used independently of the complete system which is the main focus of the description. While the invention is described in terms of feeding perforated paper sheet, it will be useful for feeding other kinds of sheet, and for applications other than document processing.

Although this invention has been shown and described with respect to a preferred embodiment, it will be understood by those skilled in this art that various changes in form and detail thereof may be made without departing from the spirit and scope of the claimed invention.

What is claimed is:

1. Apparatus for controlling the movement of a sheet downstream along a flow path, toward a finishing machine which pulls the sheet downstream cyclically at high rate, with rapid change in velocity, which comprises:

an assist unit comprised of one or more drive rollers, for moving sheet downstream along the flow path, having a tension ratio of less than 6 to 1; wherein, the sheet runs around said drive rollers with a total angle of wrap of less than 2 π radians;

means for changing the angle of wrap, and thereby the tension ratio of the assist unit; and, a dancer unit, located downstream of the assist unit, for dynamically changing the length of the flow path responsive to changes in sheet tension; the dancer unit comprising a movable roller assembly, spring biased in a direction which maximizes the length of the flow path.

2. The apparatus of claim 1, wherein the assist unit comprises a pair of drive rollers, the sheet following an S-shape flow path through the assist unit;

wherein said means for changing the angle of wrap comprises means for changing the orientation of the pair of rollers relative to the flow path.

3. The combination of apparatus for controlling movement of sheet downstream along a flow path toward a finishing machine, and a finishing machine which pulls the sheet downstream with frequent change in velocity, comprising:

an assist unit comprising at least one drive roller for moving sheet downstream along the flow path; and, a dancer unit, located downstream of the assist unit, for dynamically changing the length of the flow path responsive to changes in sheet tension, comprising a roller which applies a resiliently biased force to the sheet;

wherein, the tension ratio of the assist unit is no more than 6 to 1.

4. The apparatus of claim 3 wherein the total angle of wrap of sheet around all the drive rollers of the assist unit is no more than about 2 π radians, preferably 3 π/2 radians.

5. The apparatus of claim 3, further comprising a drag unit, located upstream of the assist unit, for retarding the downstream movement of the sheet.

6. The apparatus of claim 3 wherein the assist unit is comprised of a pair of drive rollers and no other drive rollers, wherein the sheet follows a flow path through the assist unit having an S-shape, so that the sheet is caused to wrap around a portion of the surface of each roller.

7. The apparatus of claim 6 wherein the orientation of said roller pair relative to the rest of the apparatus is changeable, to thereby effect a change in the shape of the S-shape portion of the flow path, and to cause the sheet running along the flow path to have a adjustable angle of wrap around the rollers.

8. Apparatus for controlling the movement of a sheet downstream along a flow path, toward a finishing machine which pulls the sheet downstream with frequent high rates of acceleration and deceleration, and subjects the sheet entering the machine to a certain maximum acceleration, which comprises:

an assist unit comprising at least one drive roller for moving sheet downstream along the flow path; and, a dancer unit, located downstream of the assist unit, for dynamically increasing and decreasing the length of the flow path; the dancer unit having a spring biased dancer roller assembly comprising a dancer roller for contacting the sheet and moving in space relative to the flow path at any given instant;

the assist unit moving sheet downstream responsive to tension in the sheet, which tension is sufficient to move the dancer roller against the spring bias;

wherein, the combination of spring bias and mass of the roller assembly are sufficient to substantially maintain the dancer roller in close proximity to the sheet during the time when the finishing machine is decelerating the sheet.

9. The apparatus of claim 8 wherein the roller assembly has a mass which is substantially less than four times the tensile strength, in units of force, divided by said certain acceleration.

10. The apparatus of claim 9 wherein the spring bias is provided by a system comprising one or more springs, the spring system having a spring constant which is substantially less than the maximum tension which the sheet can sustain without tearing, divided by the maximum extension of the spring system.

11. The apparatus of claim 8, further comprising:

a pair of opposing guide rails, for defining the direction of movement of the axles of a dancer roller assembly; and, the dancer roller assembly comprising a pair of journal blocks, running along the rails; the dancer roller having opposing end axles positioned in the journal blocks.

12. The apparatus of claim 8 wherein the movable roller assembly has a low mass, said low mass being substantially less than that mass which is determined by the formula $$m=4F/a_{web}$$

where m is mass of the roller, F is the maximum tension which the sheet will sustain, and $a_{web}$ is the maximum acceleration of the roller during, operation of the apparatus.

13. The apparatus of claim 12 wherein the movable roller assembly comprises a roller made of a plastic material, wherein the roller has a low mass compared to a functionally equivalent roller made of aluminum or steel.

14. The apparatus of claim 13 wherein the movable roller comprises a thin wall plastic tube.

15. In a system comprising a sheet finishing machine which pulls sheet downstream from a supply, through a drag unit and along a sheet flow path according to a first velocity vs. time cycle which is characterized by rapid velocity changes and a high frequency of cycle repetition; wherein the finishing machine thereby creates in the sheet at the point of intake thereof a cyclic peak tension; the improvement which comprises:

a two-drive roller assist unit, for causing sheet to move downstream along the flow path from the supply;

a dancer unit comprising a roller, positioned downstream of the assist unit, for dynamically changing the length of the sheet flow path while the dancer unit roller resiliently presses against the sheet;

the combination of said drag unit, two-drive roller assist unit, and dancer unit substantially reducing said cyclic peak tension.

16. The method of affecting the motion of a sheet moving downstream along a flow path running from a source or supply of sheet and toward a finishing machine which draws the sheet into the device with frequent change in velocity, including periodic stopping of the sheet, to thereby create an acceleration of the sheet and tension in the sheet at the entrance to the finishing machine, wherein the flow path has first, second, and third sequential points downstream of the source, which comprises:

(a) drawing sheet from the source and moving sheet along the flow path toward the finishing machine;

(b) providing a drag force on the sheet at said first point, to retard downstream sheet motion and thereby create a first tension force in the sheet downstream of the first point and upstream of the second point;

(c) applying force to the sheet at said second point to create in the sheet downstream of the second point a second tension which is lower than said first tension;

(d) applying to the sheet at said third point a resilient biasing force in a direction which tends to increase the length of the flow path;

(e) significantly changing the length of the flow path running between the second point and the machine, inversely to the sense of change in velocity, of the sheet at the finishing machine;

wherein, the acceleration of, and tension in, the sheet between the second point and third point are each substantially decreased compared to the acceleration of, and tension in, the sheet as it enters the machine in absence of use of the method.

17. The method of claim 16 wherein the maximum acceleration of the sheet between the second point and third point is less than one-half of the acceleration the sheet as it enters the device.

18. The method of claim 17 wherein the first tension is no greater than six times the second tension.

19. Apparatus for controlling the movement of a sheet downstream along a flow path, toward a device which pulls the sheet downstream according to a first velocity vs. time repetitively-repeated cycle, which comprises:

an assist unit comprising at least one drive roller for moving sheet downstream along the flow path;

a dancer unit, located downstream of the assist unit, for dynamically changing the length of the flow path, comprising a movable spring biased low mass dancer roller;

means for creating drag force on the sheet, located upstream of the assist unit, wherein the drag force is substantially less than the maximum tension of which the sheet is capable of sustaining without tearing;

wherein, the combination of assist unit, dancer unit, and means for creating drag cause the sheet to move from the assist unit to the dancer unit with a second cycle of velocity vs. time; wherein the times of the first and second cycles are the same;

wherein, when compared to the first cycle, the second cycle provides the sheet in the vicinity of the dancer unit with reduced acceleration and with downstream velocity spread over a longer portion of the time of the cycle; and, wherein, during use the dancer roller moves substantially, to thereby change the length of the flow path, in cooperation with the movement of sheet by the assist unit.

20. The apparatus of claim 19 wherein the assist unit has a tension ratio of less than 6 to 1.

* * * * *